US009406287B2

(12) United States Patent
Glowka

(10) Patent No.: US 9,406,287 B2
(45) Date of Patent: Aug. 2, 2016

(54) PORTABLE COMPONENT MARIMBA

(71) Applicant: John Glowka, Jupiter, FL (US)

(72) Inventor: John Glowka, Jupiter, FL (US)

( * ) Notice: Subject to any disclaimer, the term of this patent is extended or adjusted under 35 U.S.C. 154(b) by 0 days.

(21) Appl. No.: 14/951,161

(22) Filed: Nov. 24, 2015

(65) Prior Publication Data

US 2016/0148601 A1 May 26, 2016

Related U.S. Application Data

(60) Provisional application No. 62/083,569, filed on Nov. 24, 2014, provisional application No. 62/111,434, filed on Feb. 3, 2015, provisional application No. 62/156,967, filed on May 5, 2015.

(51) Int. Cl.
*G10D 13/08* (2006.01)

(52) U.S. Cl.
CPC ..... *G10D 13/08* (2013.01)

(58) Field of Classification Search
CPC ..... G10D 14/08
See application file for complete search history.

(56) References Cited

U.S. PATENT DOCUMENTS 1,150,447 A * 8/1915 Mayland ..... G10D 13/08 340/388.4
1,173,507 A * 2/1916 Haskell ..... G10D 15/00 84/170
1,760,141 A * 5/1930 Jones ..... G10D 13/08 84/313
1,772,670 A * 8/1930 Liebich ..... G10D 13/08 84/410
1,807,057 A * 5/1931 Bowers ..... G10D 13/08 84/403
1,843,553 A * 2/1932 Gladstone ..... G10D 13/08 84/403
2,021,080 A * 11/1935 Musser ..... G10D 13/08 84/403
2,085,363 A * 6/1937 Hultsch ..... G10D 13/003 84/403
2,194,545 A * 3/1940 Firestone ..... G10D 13/08 84/403
3,776,091 A * 12/1973 Suzuki ..... G10D 13/08 84/402
4,848,207 A * 7/1989 Kawai ..... G10G 5/00 84/403
4,941,386 A * 7/1990 Stevens ..... G10D 13/08 84/359
5,479,843 A * 1/1996 Yanagisawa ..... G10G 5/00 248/187.1
6,696,628 B2 * 2/2004 Yoshida ..... G10G 5/00 84/321
7,361,822 B1 * 4/2008 Hsieh ..... G10D 13/08 84/402
D609,499 S * 2/2010 Irisa ..... D17/23
7,709,715 B2 * 5/2010 Stevens ..... G10D 13/08 84/402
8,389,841 B1 * 3/2013 Stevens ..... G10D 13/08 84/410
2010/0192749 A1 * 8/2010 Sims ..... G10D 13/08 84/410

* cited by examiner

*Primary Examiner* — Robert W Horn
(74) *Attorney, Agent, or Firm* — Allen F. Bennett; Bennett Intellectual Property

(57) ABSTRACT

A portable component marimba comprising a frame having two opposing sections facing each other. A resonator support rack held in place by gravity extends between the two frame sections. A resonator assembly having a linearly arranged series of resonators extends between the two frame sections and is engaged with the resonator support rack by means of two lateral support brackets. A tone bar assembly extends between the two frame sections and includes a linear series of tone bars interconnected by two lateral laces and is supported by a tone bar support rack. The laces may be tied off on cleats located on the crossbeams. The tone bar support rack may include dampening lace support brackets. The resonator assemblies may incorporate balanced resonators. The tone bars may include sustained dampeners.

5 Claims, 10 Drawing Sheets

PORTABLE COMPONENT MARIMBA

CROSS-REFERENCE TO RELATED APPLICATIONS

This application claims priority to U.S. Provisional Application Ser. No. 62/083,569 filed on Nov. 24, 2014, U.S. Provisional Application Ser. No. 62/111,434 filed on Feb. 3, 2015, and U.S. Provisional Application Ser. No. 62/156,967 filed on May 5, 2015, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

1. Field of the Invention

The present invention relates to an improved design for a marimba. More particularly, the invention relates to a marimba or similar instrument that may be easily disassembled, transported and reassembled.

2. Description of the Related Art

A marimba is a type of idiophone similar to a xylophone, but having a more resonant and lower pitched tessitura than the xylophone. The marimba is a percussion instrument typically consisting of a set of wooden horizontal bars struck with mallets to produce musical tones. The bars are often arranged as those of a piano, with the accidentals raised vertically and overlapping the natural bars, in a manner similar to that of a piano. The most significant distinction between a marimba and a xylophone is the use of resonators. Resonators are typically cylindrical tubes extending downward from the bars and amplifying the sound generated by striking the bars. The resonators are often made from a metal or metal alloy, but may also be constructed of wood, plastic or other material.

Marimbas typically generate a distinctive sound due to the acoustic properties of rosewood, which is the preferred material for constructing the horizontal bars. However, rosewood is relatively expensive compared to plastic composites that last longer and are more easily replaced. Manufacturers of marimbas have experimented with a multitude of different materials and composites in order to better mimic the distinctive sound of rosewood.

One of the most difficult aspects of rosewood to imitate is its sustain, or rate of decay of the sound. Rosewood typically has a 2-3 second sustain. Bars made of synthetic material, metal or plastic all have a substantially longer sustain. Stop pedals similar to those used in pianos may shorten the sustain of composite materials but do not well imitate the natural fade of the sustain of rosewood.

Marimbas historically are also relatively bulky and must be transported using a van, truck or other large vehicle. This makes them impractical compared to other instruments such as guitars, drums, electric keyboards and other instruments.

In view of the foregoing, it is desirable to provide a system and method for accurately reproducing the sound produced by natural rosewood bars in a marimba.

It is also desirable to provide a marimba that is easily disassembled, transported and reassembled.

BRIEF SUMMARY OF THE INVENTION

Disclosed is a portable component marimba comprising a first stand having a first mounting block and two web supporting posts. A second stand also having a second mounting block and two web supporting posts is positioned facing, or opposing, the first stand. A resonator support bracket is mounted on the first and second mounting blocks and extends between the stands. A resonator assembly having a linearly arranged series of resonators and two resting tabs located on each side of the series of resonators may be placed on and in the support bracket. The resting tabs are configured to lie on top of and flush with the resonator support bracket. A tone bar assembly extends between the web supporting posts of the first stand and the second stand. The tone bar assembly has a linear series of tone bars held in place by a tone bar web. The tone bar web extends between the web supporting posts of the first stand and the web supporting posts of the second stand.

It is therefore an object of the present invention to provide a marimba made of a few components that may be easily and quickly assembled and disassembled for transportation. It is another object of the invention to provide a means for suspending tone bars over the resonators using a web capable of modulating the sustain and other audio qualities of the tone bars.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
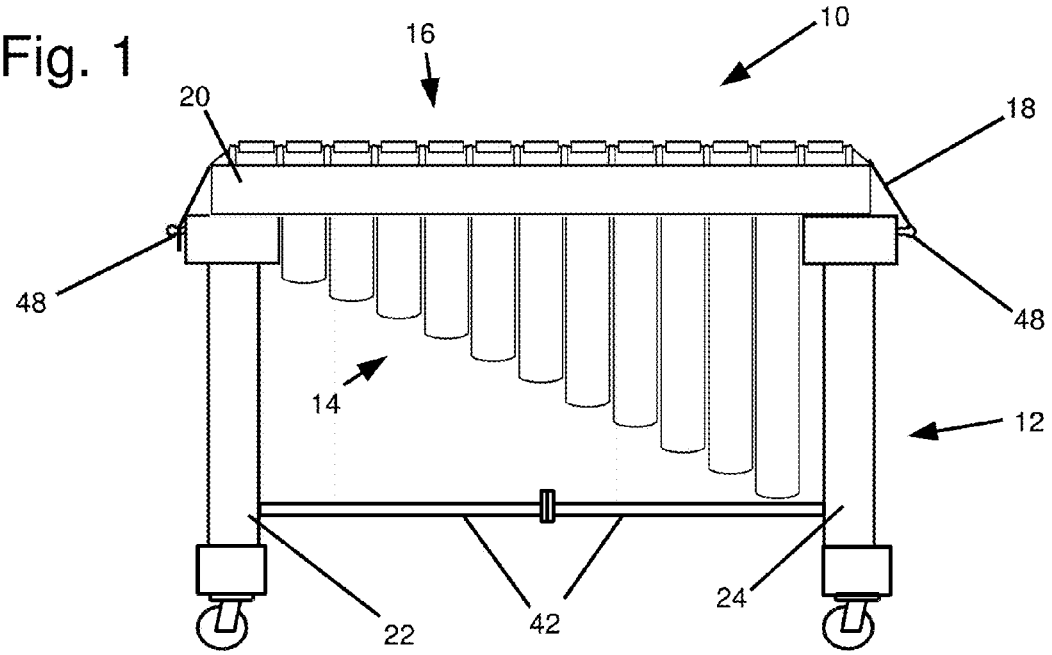
FIG. 1 is a side view of a portable component marimba in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is an invention for providing an improved marimba having dampener mechanisms that may allow use of tone bars composed of various materials to accurately imitate the sustain of natural rosewood tone bars. The invention also provides a marimba composed of discrete components that may be disassembled and reassembled in accordance with principles of the invention.

Two frame sections may be positioned opposing, or facing, each other. Each frame section may include one or more mounting blocks on an upper crossbeam. A resonator support rack may attach to mounting blocks on each frame section and extend between them. Resonators may have lateral support brackets on either side of the resonators and which rest upon the resonator support rack and allow the resonators hang from the rack. Resonators may be grouped into linear series which share lateral support brackets. The frame sections may include mounting posts on either side of the mounting blocks. Tone bar racks may be extended between the mounting posts of opposing frame sections and may include web support brackets. Tone bars, interconnected by a web, may be aligned above the tone bar support racks such that the lie between the web support brackets and the web is supported by the brackets. Assembly and disassembly of the discrete components may be accomplished rapidly by hand.

FIG. 1 shows a portable component marimba 10 in accordance with the principles of the invention. The portable component marimba 10 may include a frame 12 supporting several resonators 14 and several tone bars 16, wherein each tone bar is position directly above a corresponding resonator 14. The tone bars 16 may be interconnected by two laces 18 that travels through channels extending horizontally through the tone bars 16. The laces 18 are supported by a plurality of lace bar support brackets extending upward from a tone bar support rack 20 and cradle portions of the laces 18 between adjacent tone bars 16. The laces 18 may be anchored by being tied to cleats 48. In some embodiments, the frame 12 may be comprised of two components, a first frame section 22 and a second frame section 24.

Figure 2:
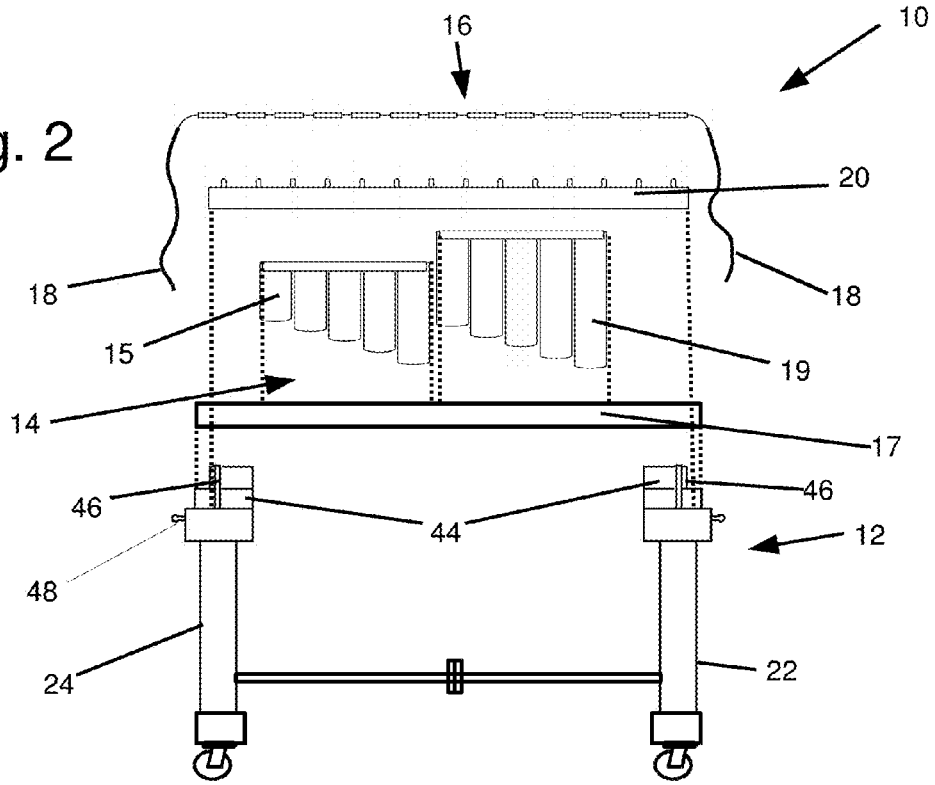
FIG. 2 is an exploded side view of a portable component marimba in accordance with the principles of the invention.

FIG. 2 shows an exploded view of the portable component marimba 10 of FIG. 1. The tone bars 16 have been lifted above the other components and the laces 18 have been detached from the cleats 48. The exploded view of FIG. 2 reveals that the resonators 14 are components of two separate resonator assemblies 15 and 19. Also visible is the resonator support rack 17. The resonator support racks 17 may be supported by two opposing mounting blocks 44, one on each of the frame sections 22 and 24 and configured to face each other. Also visible are the mounting posts 46 by which the tone bar support rack 20 is attached to the frame sections 22 and 24.

Figure 3:
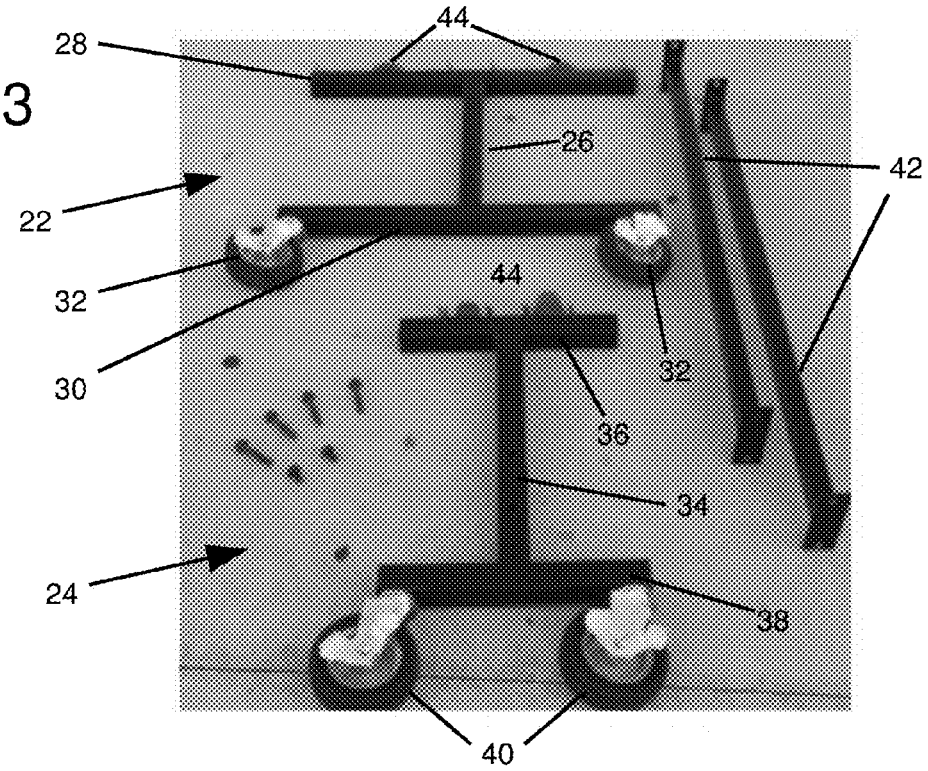
FIG. 3 is a perspective view of components of a frame of a portable component marimba in accordance with the principles of the invention.
Figure 4:
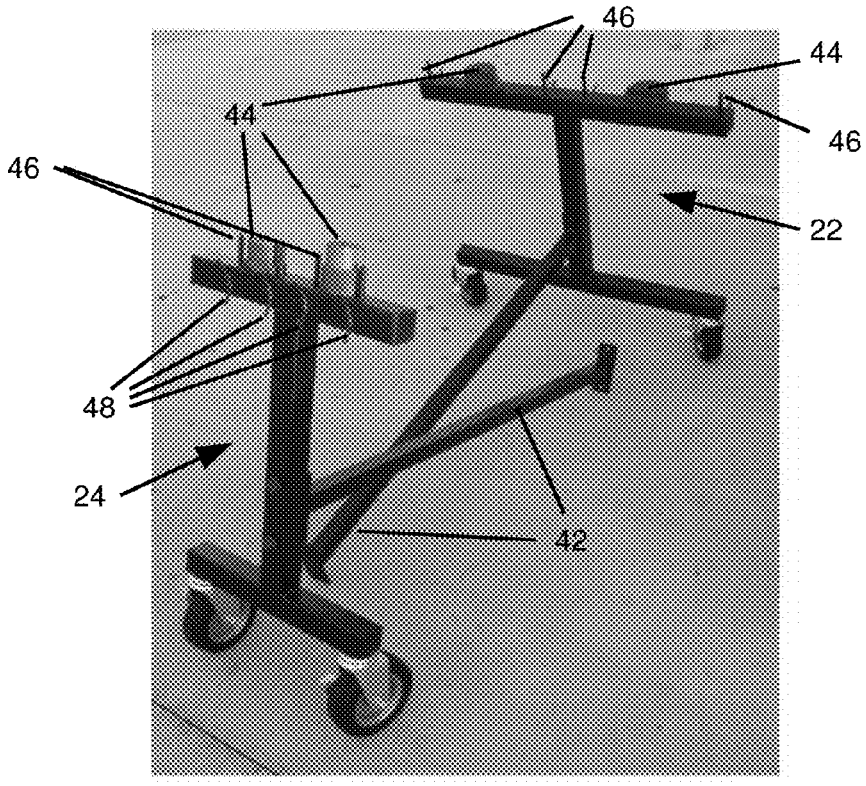
FIG. 4 is a perspective view of a partially assembled frame of a portable component marimba in accordance with the principles of the invention.

FIGS. 3 and 4 also show several components of the frame 12 for a portable component marimba 10. FIG. 2 shows the various components of the frame 12 disassembled from each other for transportation. The frame may include two frame sections 22 and 24. The first frame section 22 includes a strut 26 supporting a crossbeam 28. At the bottom of strut 26 is an elongate footer 30 having two distal downwardly extending rotating wheels 32. Similarly, second frame section 24 may include a strut 34 supporting a crossbeam 36. At the bottom of strut 34 is a footer 38 having to distal downwardly extending rotating wheels 40. The frame may also include of two stabilizer bars 42 that may be bolted to each other and to the first member 12 and second member 14. Both of the frame sections 22 and 24 may include on their respective crossbeams 28 and 36 one or more mounting blocks 44, mounting posts 46 and web cleats 48, the functions of which will be described in more detail below. FIG. 3 shows the first frame section 22 and second frame section 24 partially assembled, having the stabilizer bars 42 connected, and facing one another such that their respective mounting blocks 44 and mounting posts 46 each other.

Figure 5:
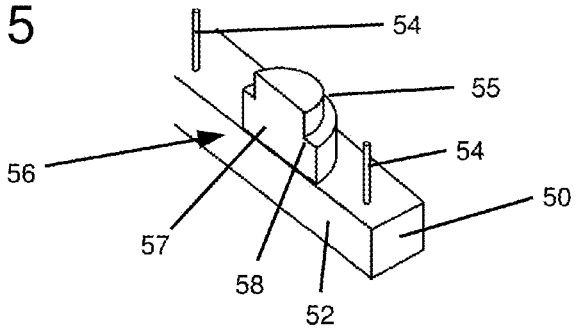
FIG. 5 is a perspective view of a crossbeam of a portable component marimba in accordance with the principles of the invention.
Figure 6:
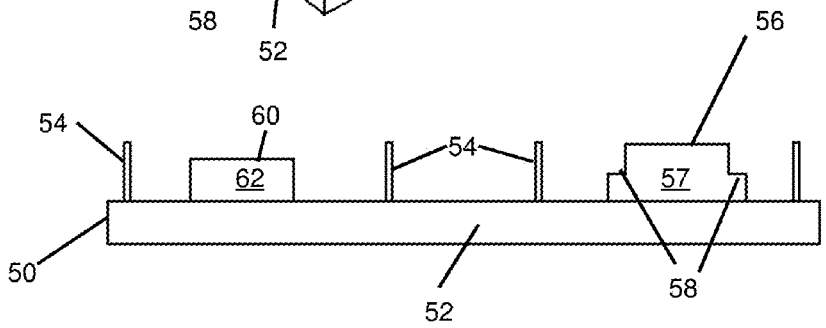
FIG. 6 is a front view of a crossbeam of a portable component marimba in accordance with the principles of the invention.

FIGS. 5 and 6 show a crossbeam 50 having two mounting blocks 56 and 60, each having two mounting posts 54 on either side. It may be seen in FIG. 4 that mounting block 56 may have a substantially flat facing side 57 and a curved rear side 55. The rear side 55 of mounting block 56 may also include a shoulder 58 that may be used to support a resonator rack, described in more detail below. The mounting block 60 includes a substantially flat facing side 62 and a curved rear side, but does not include a shoulder. The facing sides 62 and 57 of the mounting blocks 60 and 56 are located on the facing side 52 of the crossbeam 50. The facing sides 52, 62, and 57 are so designated because they face an opposing second frame section having reciprocal components.

Figure 7:
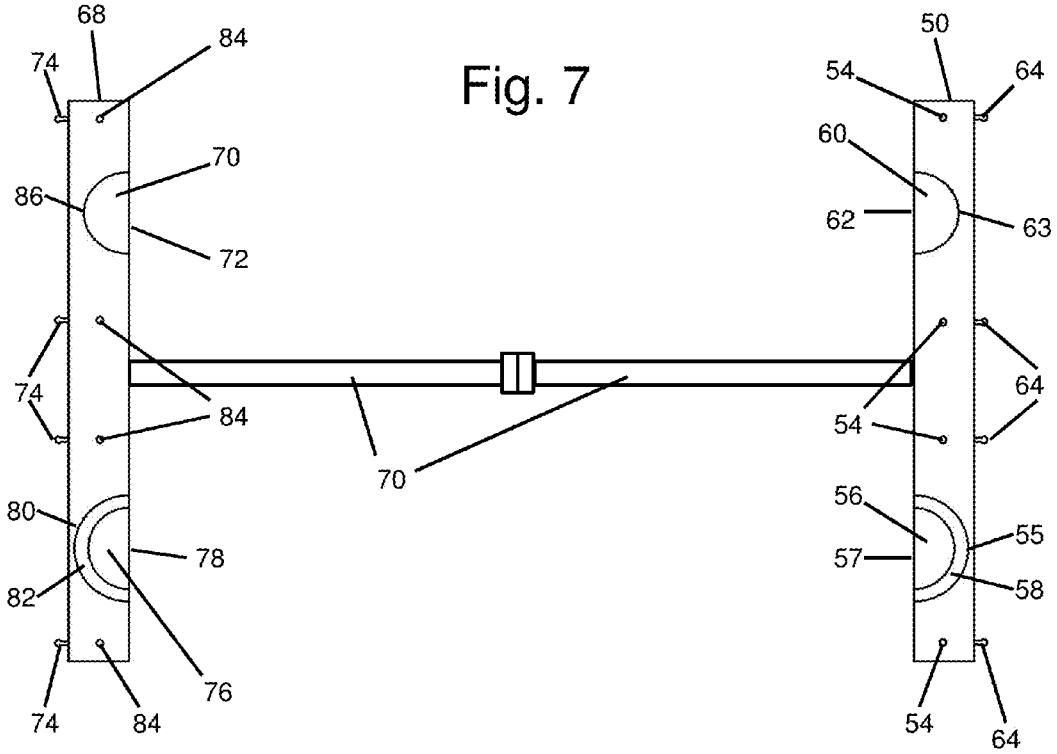
FIG. 7 is a top view of a frame of a portable component marimba in accordance with the principles of the invention.

FIG. 7 shows the crossbeam 50 of FIGS. 5 and 6 facing a second crossbeam 68 to which crossbeam 50 is attached by stabilizing bars 70 such that cross beams 50 and 68 face each other. The second crossbeam 68 may be substantially symmetric with crossbeam 50 such that they represent mirror images of each other. Alternatively, one crossbeam may be wider than another in order to accommodate tone bars and resonators of gradually increasing size as the progress across the distance between the opposing crossbeams. Crossbeam 68 may include a mounting block 70 opposite to the mounting block 60 of crossbeam 50, and facing side 72 of mounting block 70 faces the facing side 62 of mounting block 60. Similarly, mounting block 76 may be positioned opposite to mounting block 56 such that facing side 78 of mounting block 76 is opposite to and faces facing side 57 of mounting block 56. Mounting block 76 may also include a rear side 80 that is curved and includes a shoulder 82. Crossbeam 68 may also include mounting posts 84 opposite to mounting posts 54 of crossbeam 50.

Figure 8:
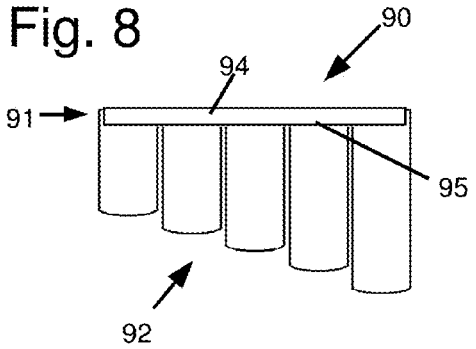
FIG. 8 is a side view of a resonator assembly of a portable component marimba in accordance with the principles of the invention.
Figure 9:
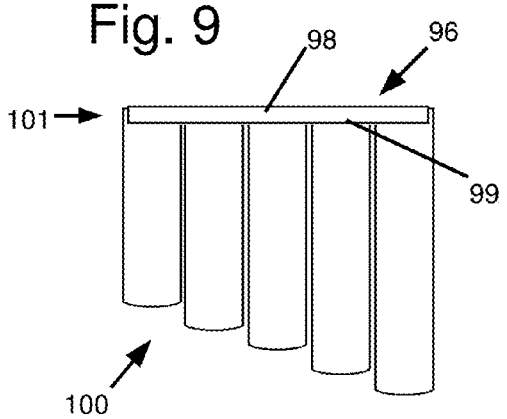
FIG. 9 is a side view of another resonator assembly of a portable component marimba in accordance with the principles of the invention.
Figure 10:
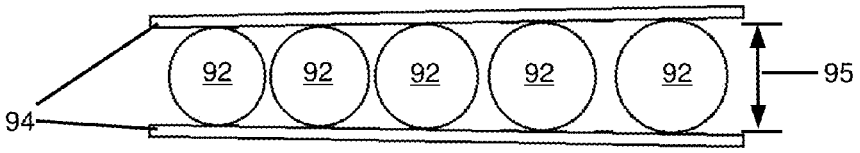
FIG. 10 is a top plan view of a resonator assembly of a portable component marimba in accordance with the principles of the invention.

FIGS. 8, 9 and 10 show to resonator assemblies 90 and 96. Resonator assembly 90 includes five resonators 92 arranged in a linear series between two lateral resonator support brackets 94. The resonators 92 may be arranged such that there top ends 91 lie flush with each other and with the lateral resonator support brackets 94. The resonators 92 may have different lengths and widths and therefore extend different distances downward from the lateral support brackets 94. The bottom surfaces 95 of the lateral support brackets 94 may be substantially flat, or may be otherwise configured to have a surface complementary to the top surface of a resonator support rack. Typically, resonators are aligned such that they are progressively longer in one direction. Those skilled in the art of marimba operation will appreciate that resonators have lengths and widths that increase in correlation to the widths of their respective tone bars.

The resonator assembly 96 shown in FIG. 9 includes a series of linearly aligned resonators 100 having lengths and widths that increase progressively in downward but whose top ends 101 all lie flush with each other and the lateral resonator support brackets 98. It may be desirable for the resonators of a marimba to be separated into resonator assemblies according to their range. For example, the resonator assembly 90 may include resonators for tone bars in a soprano range while the resonator assembly 96 may include resonators for tone bars in an alto range. The lateral resonator support brackets 94 may be separated by a distance 95, which also may be approximately equal to the diameter of the resonators 92.

As shown in FIG. 10, the lateral resonator support brackets 94 of resonator assembly 90 may have a distance that increases along with the increases in width of the progressively larger resonators 92. The resonator assemblies may generally have substantially bilateral symmetry. The bottom surfaces 99 of the lateral support brackets 98 may be substantially flat, or may be otherwise configured to have a surface complementary to the top surface of a resonator support rack.

Figure 11:
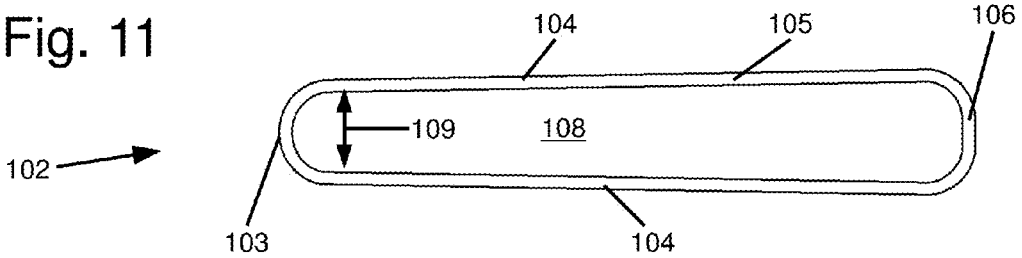
FIG. 11 is a top plan view of a resonator support rack for a portable component marimba in accordance with the principles of the invention.
Figure 12:
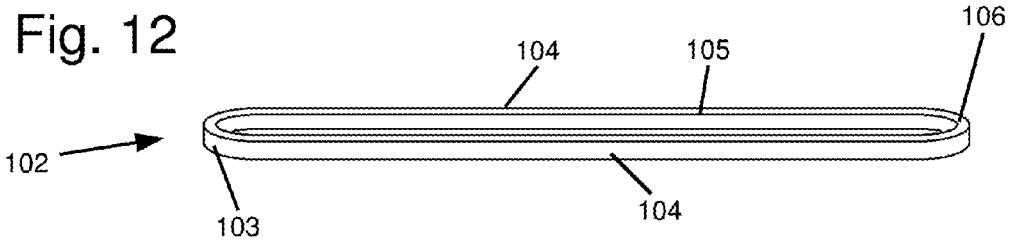
FIG. 12 is a perspective side view of a resonator support rack for a portable component marimba in accordance with the principles of the invention.

FIGS. 11 and 12 show a resonator support rack 102 in accordance with the principles of the invention. Resonator support rack 102 may be formed as a single unitary body or may be comprised of one or more separate pieces that may be bolted or otherwise removably connected to one another. The resonator support rack 102 may include two elongate substantially parallelepiped arms 104 extending between two curved collars 102. The collars 103 and 106 may be configured to abut the rear sides of mounting blocks found on crossbeams as described above. An opening 108 between the arms 104 of the resonator support bracket 102 may be separated by a distance 109 that may be increase along the length of the arms 104 from the smaller collar 103 to the larger collar 106 corresponding to the change in distance between lateral support brackets of a resonator assembly, for example, the changing distance 95 between brackets 94 of resonator assembly 90. As a result, the support brackets 94 may align with the rack arms 104 such that the resonator assembly may rest nested within the bracket 102. Optionally, the resonator support rack 100 to may be comprised of a material sufficiently flexible to allow the opening 108 to be pulled wide enough to temporarily permit passage of an entire resonator assembly, but will retract to its original distance 109 when the arms 104 are not forcibly held apart. The top surface 105 of the resonator support rack 102 may be substantially flat or may be otherwise configured to be complementary to the bottom surfaces of lateral resonator support brackets.

In the embodiment shown, the resonator assemblies 90 and 96 include resonators 92 and 100 that have increasing diameter along the length of the assembly. It may be desirable to use resonators having substantially the same diameters and lateral support brackets that are substantially parallel to one another. In that case, a corresponding resonator support rack may have arms that are substantially parallel. So long as the lateral resonator support brackets are configured to overlap the resonator support rack arms, the geometry of the resonator support rack and the lateral resonator brackets may be suitable for use in accordance with the principles of the invention.

Figure 13:
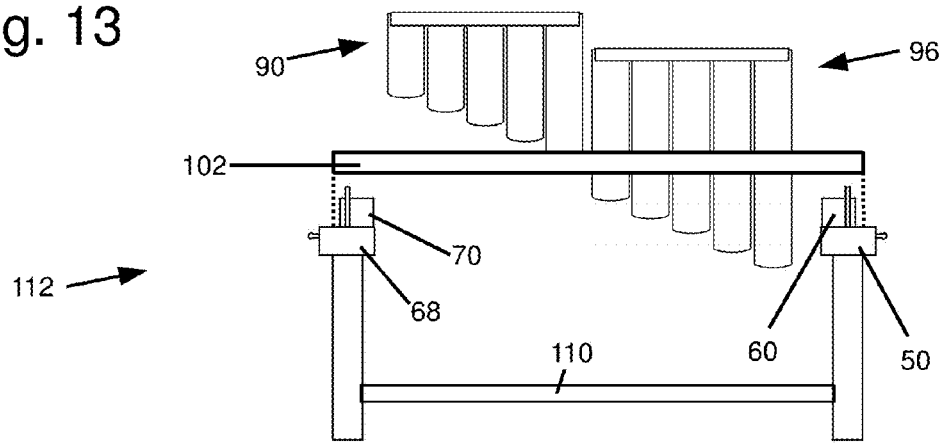
FIG. 13 is a partially exploded side view of a portable component marimba in accordance with the principles of the invention.

FIG. 13 shows the resonator support rack 102 and the resonator assemblies 90 and 96 being installed on to crossbeams 68 and 50. For clarity, the resonator support racks and resonator assemblies are shown as having uniform widths rather than a graduated widths. The crossbeams 68 and 58 are positioned opposite to and facing each other as shown in FIG. 7. The resonator support rack 102 may be placed over the crossbeams 68 and 50 and lowered onto them such that the collars 106 wrap around the rear sides of the mounting blocks 60 and 70. A stabilizing rod 110 may facilitate proper orientation and distance of the two crossbeams 50 and 68 relative to each other. When the collars 106 of the resonator support rack one and two lie flush with the rear sides of the mounting blocks 60 and 70, gravity may hold the resonator support rack 102 in place.

Once the resonator support rack 102 has been mounted on two the crossbeams 50 and 68 by placing the collars 106 around the rear sides of the mounting blocks 60 and 70, the resonator assemblies 90 and 96 may be incorporated into the portable component marimba 112. As explained above, the arms 104 of the support rack 102 are spaced apart a distance sufficient to allow passage of the resonators 92 and 100. The resonators of the resonator assemblies 90 and 96 may therefore be lowered into the space 108 between the support rack's arms 104 until the lateral support brackets 94 and 98 impinge upon the upper surface 105 of the resonator support rack 104. Because the lower surfaces 95 and 99 of the lateral resonator support brackets may be configured to be complementary to the top surface 105 of the resonator support rack 102, they will rest upon the top surface 105 of the resonator support rack 102 and not pass through opening 108. The action of gravity may retain the resonator assemblies in place on the resonator support rack 102.

Figure 14:
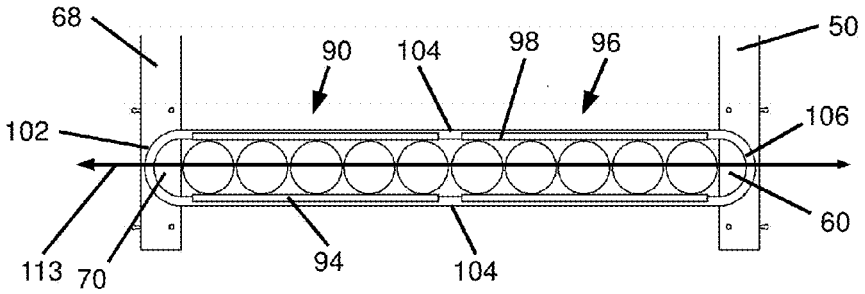
FIG. 14 is a top plan view of a partially assembled portable component marimba in accordance with the principles of the invention.

FIG. 14 shows the portable component marimba 112 wherein the lateral support brackets 94 and 98 lie atop the resonator support rack 102. The resonator assemblies may abut one another and/or the crossbeams, thereby further securing the engagement of the resonator support rack 102 with the mounting blocks 60 and 70. The resonator support rack 102, the resonator assemblies 90 and 96 as well as the mounting blocks 70 and 60, the arms 104 of the resonator support rack 102 and the lateral resonator brackets 94 and 98 may all be substantially aligned with and parallel to a longitudinal axis 113.

Figure 15:
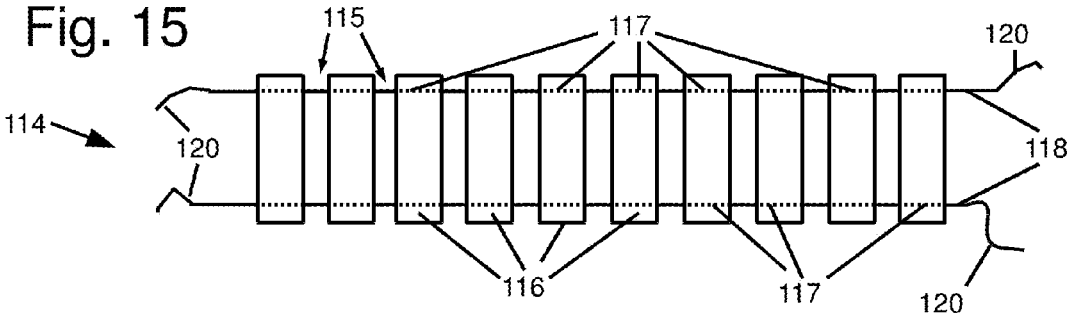
FIG. 15 is a top plan view of a tone bar assembly of a portable component marimba in accordance with the principles of the invention.
Figure 16:
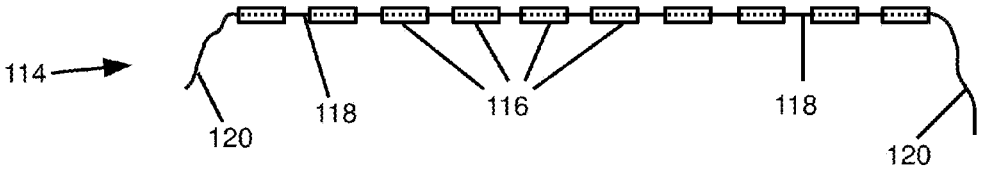
FIG. 16 is a side view of a tone bar assembly of a portable component marimba in accordance with the principles of the invention.

FIGS. 15 and 16 show a tone bar assembly 114 in accordance with the principles of the invention. The tone bar assembly 114 may include a plurality of tone bars 116 arranged as a linear series. Typically the tone bars 116 are arranged in an order of progressively increasing or decreasing tones. Each tone bar may be configured to aligned with a particular resonator. The tone bars 116 may be interconnected by two laces 118 that may be threaded through transverse lateral channels 117 at or near the bar nodes that extend through the tone bars 116. The channels 117 may be transverse to the length of a tone bar but substantially parallel to the alignments of the resonators. Those skilled in the art will appreciate that there are other configurations possible for connecting the laces 118 with the tone bars 116 that may or may not include transverse lateral channels 117. The distal ends 120 of the laces 118 may extends a distance beyond the tone bars 116 sufficient to provide enough length to be tied off on cleats on the crossbeams or otherwise anchored in accordance with the principles of the invention.

Figure 17:
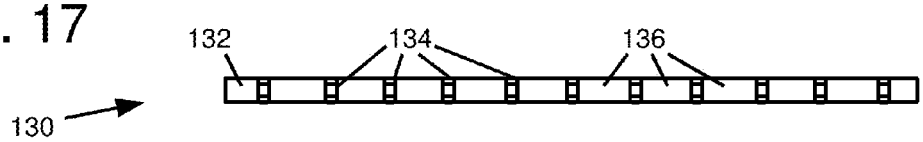
FIG. 17 is a top plan view of a tone bar support rack of a portable component marimba in accordance with the principles of the invention.
Figure 18:
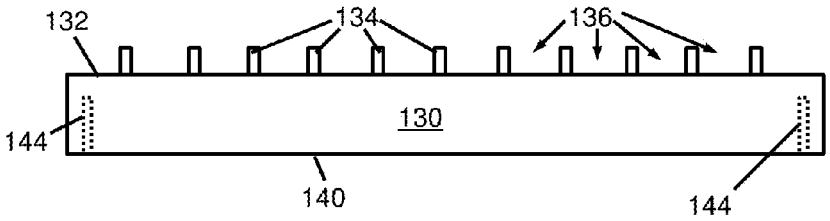
FIG. 18 is a side view of a tone bar support rack of a portable component marimba in accordance with the principles of the invention.

FIGS. 17 and 18 show a tone bar rack 130 in accordance with the principles of the invention. A tone bar rack 130 may be an elongate beam or plank that may be mounted onto two opposing mounting posts on to frame sections facing each other. In this embodiments, the tone bar rack 130 has a parallelepiped, substantially orthogonal configuration. The top surface 132 may be substantially flat but may optionally be curved or include other geometries. The bottom surface 140 may include two small hollow bores 144 configured to receive mounting posts on two opposing crossbeams such that the tone bar support rack 130 extends between the two facing crossbeams.

A series of lace support brackets 134 may be arranged substantially equidistant from one another along the length of the tone bar rack 130 and may correspond to the interstices 115 of a tone bar assembly in accordance with the principles of the invention. The lace support brackets 134 may suspend the laces 18, and thus the tone bars 116, at a predetermined height and positioned relative to the resonators and other components of a portable marimba components in accordance with the principles of the invention. The lace support brackets 134 may also retain the tone bars 116 in a proper orientation above each tone bar's corresponding resonator.

Figure 19:
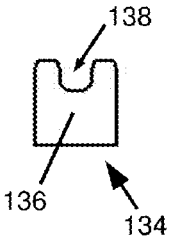
FIG. 19 is a front plan view of a dampening lace support bracket of a marimba in accordance with the principles of the invention.

FIG. 19 provides an enlarged view of a dampening lace support bracket 134 and accordance with principles of the invention. The dampening lace support bracket 134 may have a body 136 and an upper groove configured to support a lace 118 of the tone bar assembly 114. The body 136 of the dampening lace support bracket 134 may be formed from elastomeric compounds such as rubber. The use of rubber or similar material when constructing the dampening lace support bracket 134 provides dampening of the sustain of the tone bars 116 and acts as a shock absorber preventing or minimizing the transfer of vibrations to other components of the instrument.

When the tone bars 116 are comprised of a plastic or composite material instead of natural rosewood, the use of dampening lace support brackets, in conjunction with adjusting the tension of the laces, may provide an indirect dampening of the tone bars. This may facilitate a means of accurately imitating the natural sustain of a Rosewood tone bar. This may provide a more accurate means of adjusting the sustain of the notes than other methods that may use more rigid posts or rubber dampeners applied directly to the tone bars. While the dampening lace support bracket 134 shown here is incorporated into a portable component marimba, a dampening lace support bracket comprised wholly or partially of an elastomeric or other vibration absorbing material may be incorporated into any marimba, xylophone or similar mallet percussion instruments.

Figure 20:
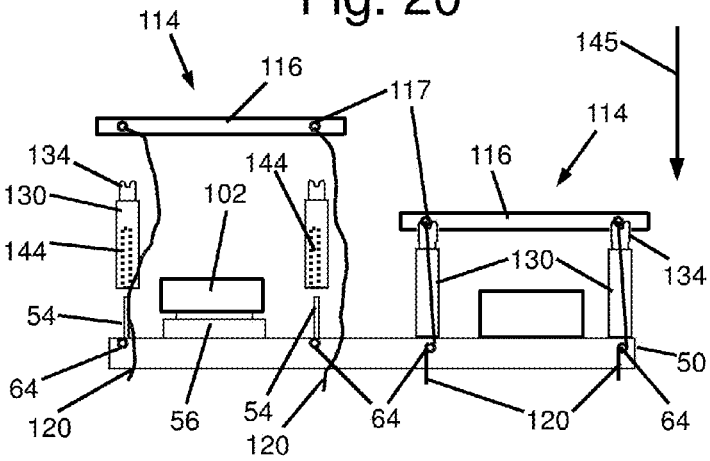
FIG. 20 is a partially exploded side view of a portable component marimba in accordance with the principles of the invention.
Figure 21:
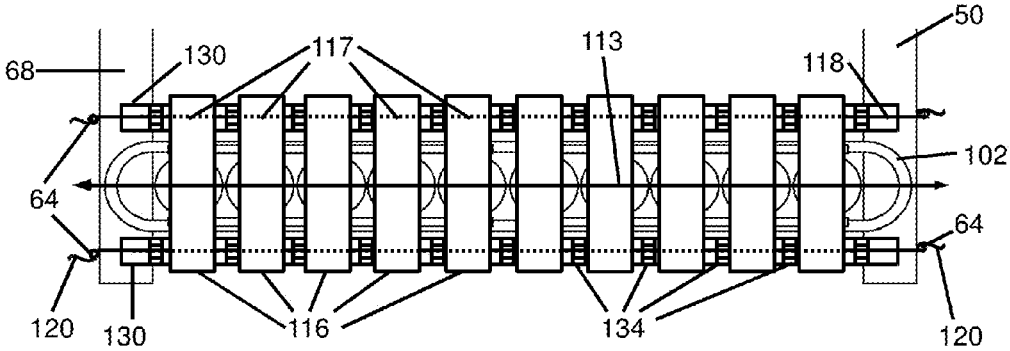
FIG. 21 is a top plan view of a portion of a portable component marimba in accordance with the principles of the invention.

FIGS. 20 and 21 illustrate the addition of a tone bar assembly 142 and tone bar rack 130 on to the crossbeam 50 subsequent to attachment of the resonator assemblies as shown in FIG. 13 in accordance with the principles of the invention. Two tone bar support racks 130 may be attached to each of the crossbeams by lowering them in the direction of arrow 145 such that the mounting posts 54 may be inserted into the bores 144 on the bottom surface 140 of the tone bar support racks 130 rest upon the top of the crossbeams. As with the resonator support rack 102, the tone bar support racks 130 may be secured in place primarily by the action of gravity.

Once the tone bar support racks 130 are in place, the tone bar assembly 114 may be laid across it such that the tone bars 116 are placed in the interstices 136 between the lace support brackets 134. The lace support brackets 134 the position of the tone bars in the correct position above their corresponding resonators. The ends 120 of the laces 118 may be pulled taut and fastened to the cleats 64. The cleats 64 may be a porn cleats, a cam cleats having spring loaded cams to pinch a lace, a jam cleats having a V-shaped slot, a clam cleat or other device suitable for tying off the end 120 of the laces 118. When assembling a portable component marimba, an operator may adjust the tension of the laces 118 by adjusting their attachment to the cleats 64.

Referring now to FIG. 20, it may be seen that the tone bar assembly 114 and the tone bar support racks 130 may also be aligned with longitudinal axis 113 and that the individual tone bars 116 are spaced, in part due to the positioning of the lace support brackets 134, such that each tone bar 116 is correctly positions above its respective resonator.

The above figures and description explain the assembly of a frame, resonators and tone bars, along with the necessary racks and brackets, of a portable component marimba in accordance with the principles of the invention. A marimba and accordance with the invention may have a single series of tone bars as shown in FIG. 21 or the process may be repeated with other mounting blocks, tone bar assemblies and resonator assemblies to form additional rows that may be substantially adjacent to the one shown.??.

Figure 22:
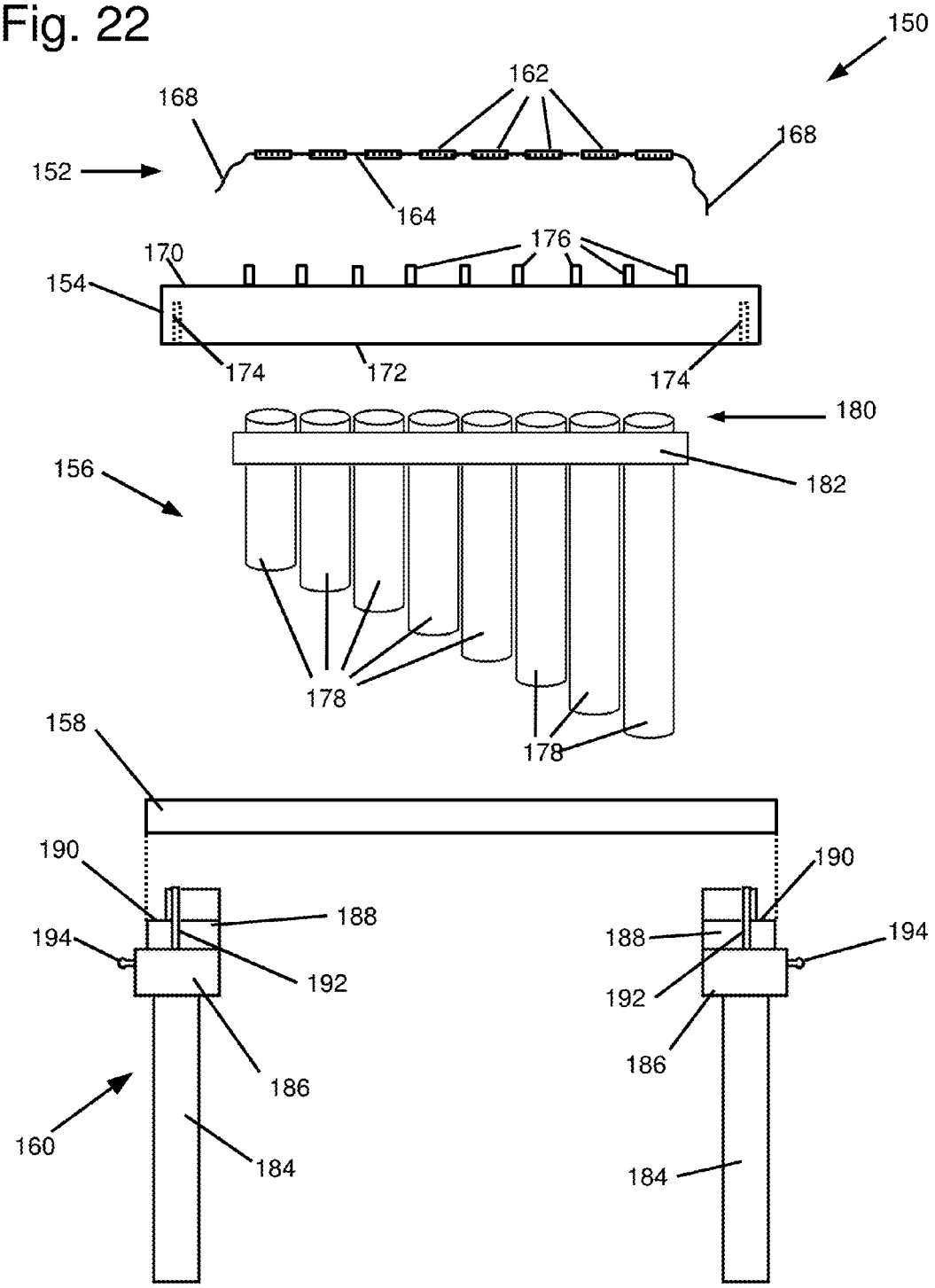
FIG. 22 is an exploded view of a portable component marimba in accordance with the principles of the invention.

FIG. 22 shows an exploded view of another alternative embodiment of a portable component marimba 150 in accordance with the principles of the invention. The portable component marimba 150 may include a tone bar assembly 152, two tone bar racks 154, a resonator assembly 150, a resonator support rack 158 and a frame 160. The tone bar assembly 152 may include a plurality of tone bars 162 interconnected by two lateral laces 164. As with the other embodiments shown, the laces 164 have free ends 168 that may be attached to a cleat.

The portable component marimba 150 may also include two tone bar support racks 154 having a top side from which a plurality of lace support brackets 176 extend and may engage the laces 164. The bottom 172 of the support rack 154 may include two slots for receiving a mounting post.

The portable component marimba 150 may also include a resonator assembly 156 having a plurality of resonators 178 which are arranged in a linear series such that they are tops 180 are flush with one another. The resonator assembly 156 may also include two lateral resonator brackets 182. The resonator support rack 158 may be configured to engage the lateral support brackets 182.

The frame 160 may include two symmetric, mirror image sections having a stanchions 184 supporting crossbeams 186. Each crossbeam may include a mounting block 188 configured to engage and supports the resonator support rack 158. Each of the mounting blocks 188 may include a shoulder 194 engaging the resonator support rack 158. Each crossbeam 186 may also include two mounting posts 192 for attachment of the tone bar support rack 154. The crossbeams 186 may also include two cleats 194 associated with each mounting post and to which the ends 168 of the laces 164 may be removably attached.

Figure 23:
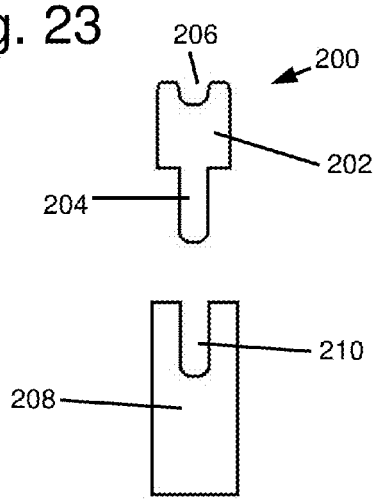
FIG. 23 is an enlarged view of a dampening lace support bracket and tone bar support rack of a portable component marimba in accordance with the principles of the invention.
Figure 24:
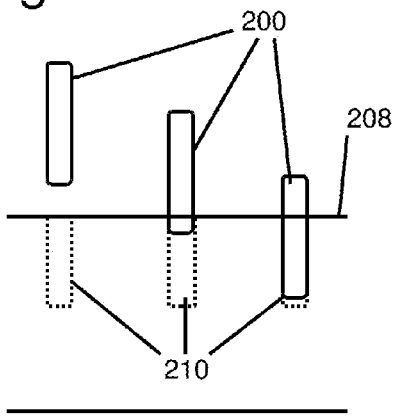
FIG. 24 is an enlarged side view of dampening lace support brackets being inserted into a tone bar support rack of a portable component marimba in accordance with the principles of the invention.

FIGS. 23 and 24 show an alternative embodiment of a dampening lace support bracket 200. In the construction of marimbas and similar devices, it is common to provide two posts through which laces, strings or twine to lie between. These post both properly align the tone bars and keep them separated from one another. They are typically of a very solid material such as metal. Thus, may transmit some of the vibration into other components of the marimba. The dampening lace support brackets 200 of the present invention, on the other hand are designed to have a dampening effect to the instrument. As with the dampening lace support bracket shown in FIG. 19, the dampening lace support bracket 200 may be incorporated into a portable component marimba or may be similarly incorporated into other mallet percussion instruments such as vibraphones and the like where holes are placed in laterally through the bar at the nodes of the fundamental vibration. The dampening lace support brackets may be completely wholly or partially of an elastomeric material or other material capable of absorbing vibrations.

A dampening lace support bracket 200 may include a body 202 having a dowel 204 extending downward from the body 202 and an upper lace groove 206 that cradles the laces. The dampening lace support bracket 200 may be comprised of rubber or other elastomeric materials. As a result, instead of transmitting vibrations from a tone bar, it isolates the vibrations of a tone bar, providing a cleaner sound for the overall instrument especially over time. Typically the posts or other guides used to support and position laces or strings are typically permanently affixed to a support bracket. As a result if one or more of them break, it is very time-consuming and difficult requiring a craftsman to repair.

As shown in FIG. 23, the insertion pin 204 of the dampening lace support bracket 200 fits inside a slot 210 in the upper side of the tone bar support bracket 208. The dowel 204 and the slot 210 may form a friction fit, thereby securing the dampening lace support bracket 200 in place. (Solid rubber construction is the dowel which fits into a slot. There is a set screw through the rail, slot and rubber dowel making them easily replaceable). Should the dampening lace support bracket 200 become damaged or otherwise require replacement, it may simply be pulled out of the slot 210 and replaced with minimal effort.

FIG. 24 shows three dampening lace support brackets 200 in successes stages of being inserted into slots 210 of a tone bar support bracket 208. Optionally, an operator of a marimba or other mallet percussion instrument may use a plurality of interchangeable dampening lace support brackets 200, each providing a different amount of absorption of vibrations. He or she may interchange the various dampening lace support brackets in order to adjust the sustains of the tone bars.

Figure 25:
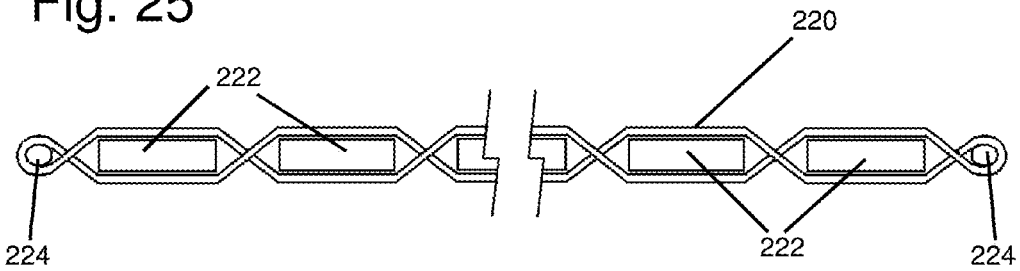
FIG. 25 is a side view of a sustain dampener engaged with a series of tone bars in accordance with the principles of the invention.

FIG. 25 shows a sustain dampener 220 comprising a loop of elastic material weaved over and under the tone bars 222 of the instrument and under tension applied in part by the dampener 220 being anchored by two opposing posts 224. By applying this dampener 220 over and under the tone bars, their sustains are limited and adjustable with variations in tension. As with the dampening lace support brackets shown in FIGS. 19, 23 and 24, the sustain dampener 220 may be incorporated into other mallet percussion instruments such as, for example, a xylophone.

Figure 26:
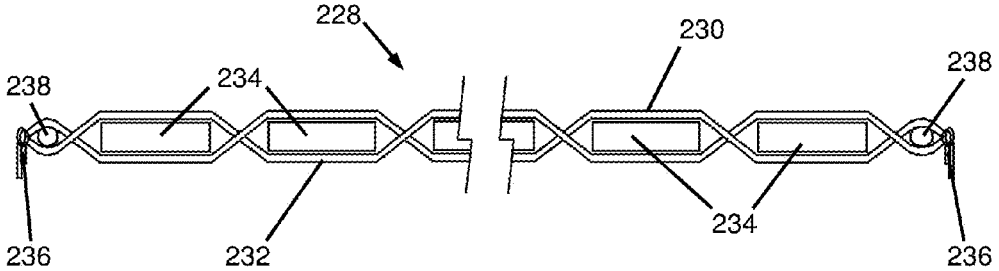
FIG. 26 is a side view of an alternative embodiment of a sustained dampener engaged with a series of tone bars in accordance with the principles of the invention.

Similarly, FIG. 26 shows an alternative sustain dampener 228 comprising two elastic cords 230 and 232 woven between the tone bars 234 and tied off at posts 238 by simply forming knots 236. The tension may be increased or decreased by adjusting the knots 236. It may be desirable to utilize one or more sustained dampeners on a single series of tone bars. It may also be desirable to utilize a dampening loop or two interwoven cords of different strengths to adjust the dampening of the tone bars. The sustain dampener 228 may be, as a dampener 220, be incorporated into other mallet percussion instruments.

Figure 27:
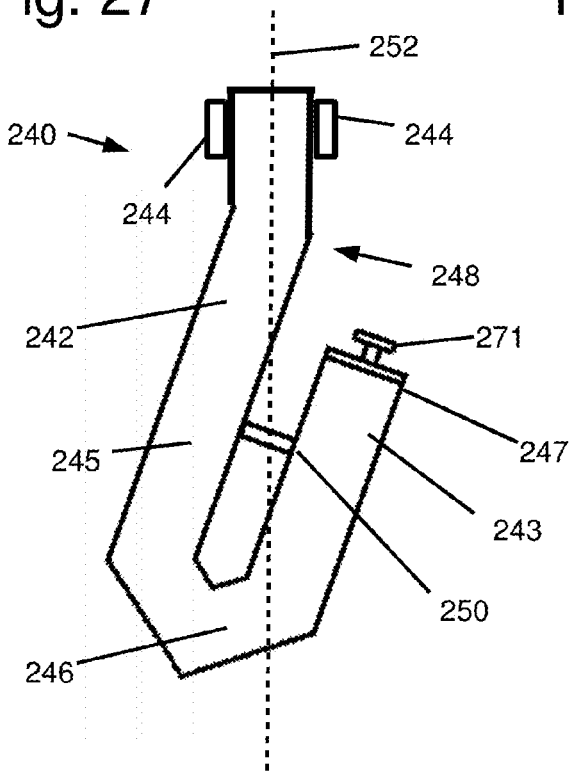
FIG. 27 is a side view of a balanced resonator in accordance with the principles of the invention.

FIG. 27 shows a balanced resonator 240 for use in accordance with the present invention. Resonator 240 may be affixed to two opposing lateral support brackets 244 for mounting in a marimba as described above. Many resonators used with marimbas are short enough to extend straight downward below the tone bars without touching the ground. However, marimbas utilize very long resonators for the lower pitched keys that may be too long to fit below a marimba placed about 3 feet above the ground. As a result, most long resonators for low notes are L-shaped, having a substantial portion running along the ground underneath the marimba. This may make a marimba particularly cumbersome and ungainly. It also results in resonators that are not amenable to being suspended in a gravity fit manner as described above.

In order to provide very long resonators that may be easily assembled and disassembled, the present invention provides U-shaped balanced resonator tube 240. Resonator tube 240 has a 180° crook or bend 246 such that the distal region 243 of the resonator is substantially parallel to the proximal region 245 of the resonator. It may be desirable to connect the distal region 243 and proximal region by a brace 250. The proximal region 245 may also include a bend 248 and the resonator that results in the center of gravity of the resonator 242 lie at a point on a line 252 that is equidistant from the two opposing lateral support brackets 244. Thus, as used herein, a "balanced resonator" generally refers to a resonator constructed such that its center of gravity is equidistant from both lateral support brackets and lies along a vertical line 252 equidistant between opposing lateral support brackets. This may generally be achieved by bending a proximal region of a resonator to provide for the proper placement of the center of gravity. By adjusting the center of gravity of a resonator 240 by incorporating the bend 248, a long resonator may be used in accordance with the principles of the invention.

The distal region 243 terminates at the resonator's distal end 247. The end 247 may include a tuner cap 271. The tuner cap 271 may prevent dust and other objects from entering the resonator, but may also allow an operator to adjust the tone of the resonator, as explained in FIG. 29 below.

Figure 28:
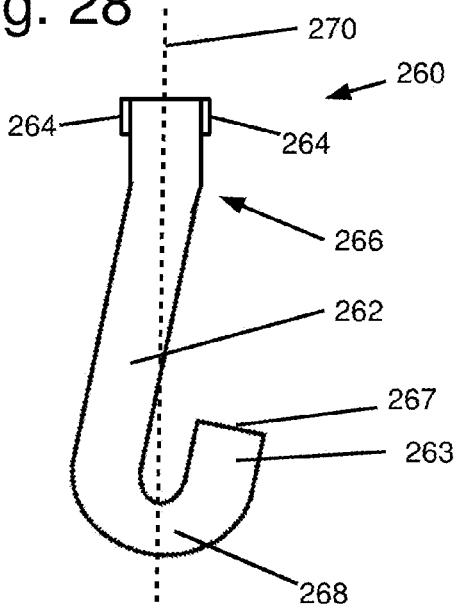
FIG. 28 is a side view of an alternative embodiment of a balanced resonator in accordance with the principles of the invention.

FIG. 28 shows another alternative embodiment of a relatively long resonator tube 260 in accordance with the principles of the invention. The resonator tube 260 includes a distal region 263 and a proximal region 262 connected by a crook 368. The bend 266 in the proximal region 262 shifts the center of gravity of the resonator 260 such that it lies along line 270 that runs vertically equidistant between the two opposing lateral support brackets 264. Because the distal region 263 of the resonator 260 is relatively small, there is no need for a breaks. By aligning the center of gravity equidistant between the opposing lateral support brackets 264, the resonator may be included in a resonator assembly that may be installed into a portable marimba as described above and secured in a proper position by gravity alone. In this embodiment, the distal end 267 does not include a tuner cap.

Figure 29:
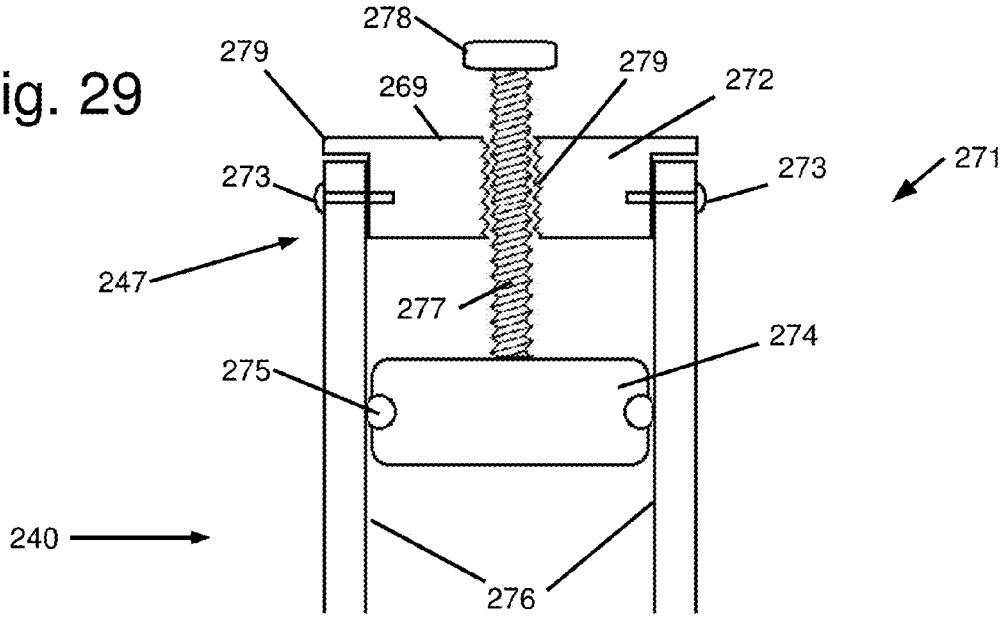
FIG. 29 is a perspective view of a portable component marimba incorporating a plurality of balanced resonators in accordance with the principles of the invention.

FIG. 29 shows a cross-section of the distal end 247 of the resonator 240. The tuner cap 271 includes a body 272 that may abut the inside wall 276 of the resonator 240. The cap 271 may be affixed to the distal end 247 of the resonator 240. In this embodiment, the tuner cap body 272 is affixed to the resonator 240 by means of bolts 273. Optionally, the cap 271 may be attached by screws, dowel rods, friction fit, threading, tabs fitting into slots or other mechanisms. The cap 271 may include an annular flange 279 that extends outward from the top 269 of the body 272. The annular flange 279 may extend a sufficient distance to substantially cover the rim of the resonator tube.

The tuner cap 271 includes a piston 274 extending downward from the body 272. The piston 274 may be substantially cylindrical and have a size that provides a snug fit between it and the interior wall 276 of the resonator 240. The piston 274 may also include a rubber seal ring (O, D, or X ring) 275 to ensure a compression fit with the interior wall 276. A threaded stem 277 extends through a threaded bore 279 in the body 272. The threaded stem 277 extends out of the body 272 and has a knob 278. By turning the knob 278, an operator may upwardly and downwardly adjust the position of the piston 274. By adjusting the position of the piston 274, an operator may adjust the effective length of the resonator 240, thereby adjusting its volume and resonance of sound as well as providing moderate adjustment of the sustain. The length or volume of any resonator required to amplify the sound of the vibrating bar varies with temperature due to the speed at which sound moves through air. Warmer temperatures require the resonators to be longer than cooler temperatures because the sound waves move faster in warmer air. The fine tuning instrument adjustment allows the effective length or volume of the resonator to match the instrument's air temperature, another important feature to portability.

Figure 30:
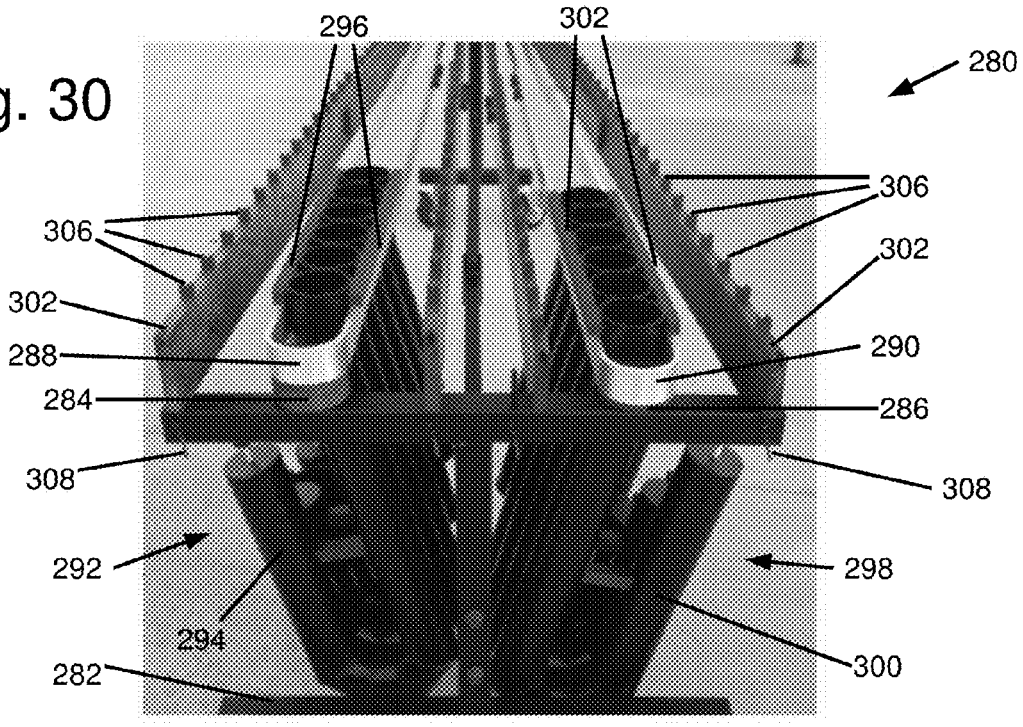
FIG. 30 is a perspective view of an alternative embodiment of a portable component marimba having a plurality of balanced resonators having tuner caps.

FIG. 30 shows a partially assembled portable marimba 280. The portable marimba 280 includes a support frame 282 having to mounting blocks 284 and 286. Two resonator support racks 288 and 290 have been placed on top of the mounting blocks 284 and 286, respectively. As described above, the support racks 288 and 290 remain fixed in place primarily as a results of the force of gravity.

A first resonator assembly 292 may consist of a series of resonators 294 constructed in a manner similar to those shown in FIG. 26. The lateral brackets 296 may rest upon the resonator support rack 288 and may be secured in place by the action of gravity. Similarly, a second resonator assembly 298 may consist of a series of resonators 300 having a linear arrangement between two lateral support brackets 302 that may rest upon the resonator support rack 290. As with the first resonator assembly 292, the second resonator assembly 298 may be secured in place by the action of gravity. Those skilled in the art will appreciate that this simplifies the assembly and disassembly of the marimba while also providing a wider range of sounds without requiring additional space.

The portable marimba 280 shown in FIG. 28 also includes tone bar support racks 302 each having a linear series of lace support brackets 306 comprised of rubber or a similar or other elastomeric material for dampening vibrations emanating from the tone bars once the assembly is complete. Cleats 308 for tying off the laces, cords or other web being used to interconnect the tone bars may also be seen. Although not shown, posts, tens or other devices for tying off a sustained dampener may be incorporated into the distal ends of the tone bar support racks 302.

The resonators shown in FIGS. 26, 27 and 28 have a sigmoidal design. It may be desirable to construct resonators having alternative configurations so long as the center of gravity remains equidistant between two opposing lateral support brackets. Furthermore, the use of the sigmoidal resonators shown here may be incorporated into a portable component marimba or into other more stationary marimbas and order to more efficiently use the space available.

Those skilled in the art will appreciate that a variety of alternative configurations may be used for various components of the invention. For example, the mounting blocks have been generally described as having curved rear sides and a circular shoulder corresponding to the curved collars of the resonator support racks. Instead of curved, the collars and shoulders and rear sides of the support racks and mounting blocks may be angular, orthogonal or other varying designs. Any geometry may be suitable that may provide removable engagement of the resonator support racks with the crossbeams, and geometries and mechanisms relying primarily on gravity to hold the marimba components secure may be preferable. Similarly, the mounting posts and the slots within the tone bar support rack may be modified to have a variety of different configurations. Optionally the mounting blocks and mounting posts may include cam locks or other mechanisms but mechanisms providing for substantially secure engagement of the components primarily by means of the force of gravity may be preferred. The laces may be comprised of any suitable material such as rope, twine or other fibrous material and may optionally be comprised of cloth, carbon fiber or even a rigid or semi rigid material.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A portable component marimba comprising:

a first frame section having a crossbeam, the crossbeam having a mounting block and two mounting posts positioned on each side of the mounting block;

an opposing second frame section having a crossbeam, the crossbeam having a mounting block and two mounting posts positioned on each side of the mounting block;

a resonator support rack extending between the first and second mounting blocks;

a resonator assembly having a series of resonators and lateral support brackets on either side of the series of resonators;

two tone bar support racks, each engaged with and extending between two opposing mounting posts on the first frame section and the second frame section;

a linear series of tone bars interconnected by two laces; and, cleats for tying off the laces.

2. The portable component marimba of claim 1 further comprising a stabilizing bar extending between the first frame section and the second frame section.

3. The portable component marimba of claim 1 wherein the components are held in place by gravity.

4. A resonator for use with a marimba comprising:

an elongate resonator tube;

a proximal region of the elongate resonator tube having an opening below and substantially parallel to a tone bar of a percussion instrument;

two lateral support brackets positioned on opposing sides of the opening in the proximal end of the resonator tube;

a distal region having an opening;

a crook between the proximal region and the distal region of the resonator tube, the resonator tube being curved about 180° in the crook;

wherein the proximal region of the resonator tube is bent at an angle sufficient to place the center of gravity of the resonator tube along a line perpendicular to the proximal opening of the resonator tube and equidistant from the lateral support brackets.

5. A resonator for use with resonators of a percussion instrument comprising:

an elongate resonator tube having an inside wall and suspended below a tone bar of an instrument, open at a proximal end adjacent to the tone bar and open at a distal end;

a cap covering the distal end of the resonator tube, the cap having a body sized to fit within the distal end of the resonator tube;

an annular flange extending outward from a top of the cap body and covering a rim of the resonator tube;

a piston within the resonator tube and abutting the inside wall of the resonator tube;

a threaded stem extending from the piston, through a bore in the body and outward to a knob, wherein turning the knob adjusts the distance of the piston from the distal end of the resonator tube.

* * * * *